United States Patent [19]

Eiring et al.

[11] 4,362,503

[45] Dec. 7, 1982

[54] PLANETARY COOLER

[75] Inventors: Karl Eiring, Oelde; Bernhard Loffler, Warendorf, both of Fed. Rep. of Germany

[73] Assignee: Krupp Polysius AG, Beckum, Fed. Rep. of Germany

[21] Appl. No.: 269,538

[22] Filed: Jun. 3, 1981

[30] Foreign Application Priority Data

Jul. 1, 1980 [DE] Fed. Rep. of Germany ..... 3024802

[51] Int. Cl.[3] ..... F27D 15/02; F27B 7/02

[52] U.S. Cl. ..... 432/80; 432/106

[58] Field of Search ..... 432/80, 78, 83, 103, 432/106

[56] References Cited

U.S. PATENT DOCUMENTS

| | | | |
|---|---|---|---|
| 3,975,147 | 8/1976 | Vering et al. | 432/106 |
| 4,045,161 | 8/1977 | Mollenkopf et al. | 432/80 |
| 4,059,397 | 11/1977 | Adler | 432/80 |

*Primary Examiner*—John J. Camby

*Attorney, Agent, or Firm*—Learman & McCulloch

[57] ABSTRACT

A planetary cooler has a plurality of circumferentially spaced cooling tube supports each of whichhas a pair of axially spaced side plates and an insert with two flanges which are fitted into openings in the side plates and welded to the latter. Each flange has a pyriform opening which communicates with a radial clearance extending between circumferentially adjacent side plates at their radially outer portions.

8 Claims, 4 Drawing Figures

PLANETARY COOLER

This invention relates to a planetary cooler comprising a plurality of cooling tubes which are arranged around the periphery of a revolving tubular furnace and which are suspended in at least one fixed bearing and at least one floating bearing, of which each bearing comprises a cooling tube support and two side plates through which it is connected to the furnace mantle, bearings adjacent one another in the peripheral direction of the furnace resting on one another and being welded together in their inner region adjoining the furnace mantle, whereas in their outer region remote from the furnace mantle they have a clearance between one another and the inner part of this clearance is pyriform or tear drop in shape with the larger end of the clearance extending towards the furnace mantle.

A suspension system for planetary cooling tubes of the type described above is known for example from German Utility Model No. 74 41 586.4. On account of the very severe and varying strains to which the welds between adjacent bearings are subjected, damage occasionally occurs in practice, generally emanating from the connecting weld between adjacent bearing support elements which adjoin the clearance zone.

Accordingly, the object of the present invention is to obviate these deficiences and to construct a suspension system for planetary cooling tubes of the kind mentioned in such a way that it is distinguished by high reliability and safety in operation, and also affords the possibility of correspondingly modifying damaged bearings of the type referred to above, and further in such a way that it is distinguished by ease of manufacture and assembly.

According to the invention, this object is achieved in that the pyriform clearance zone is formed by an insert which comprises two spaced apart flanges and a pyriform web which joins the two flanges, each of the two flanges being welded around its circumference to the side plates (cut out commensurately with the flanges) of the two adjacent bearings.

In the suspension system according to the invention, the critical weld seam establishing the connection between adjacent bearings is no longer situated—as in the past—in the region of the larger end of the pyriform clearance, but instead on a much larger radius, namely on the circumference of the flanges. As a result, the weld seam is now situated outside the maximum stress zone and is effectively protected in this way against overstressing.

Further features and advantages of the suspension system according to the invention will become apparent from the claims and from the following description of preferred embodiments illustrated largely diagrammatically in the accompanying drawings, wherein:

Figure 1:
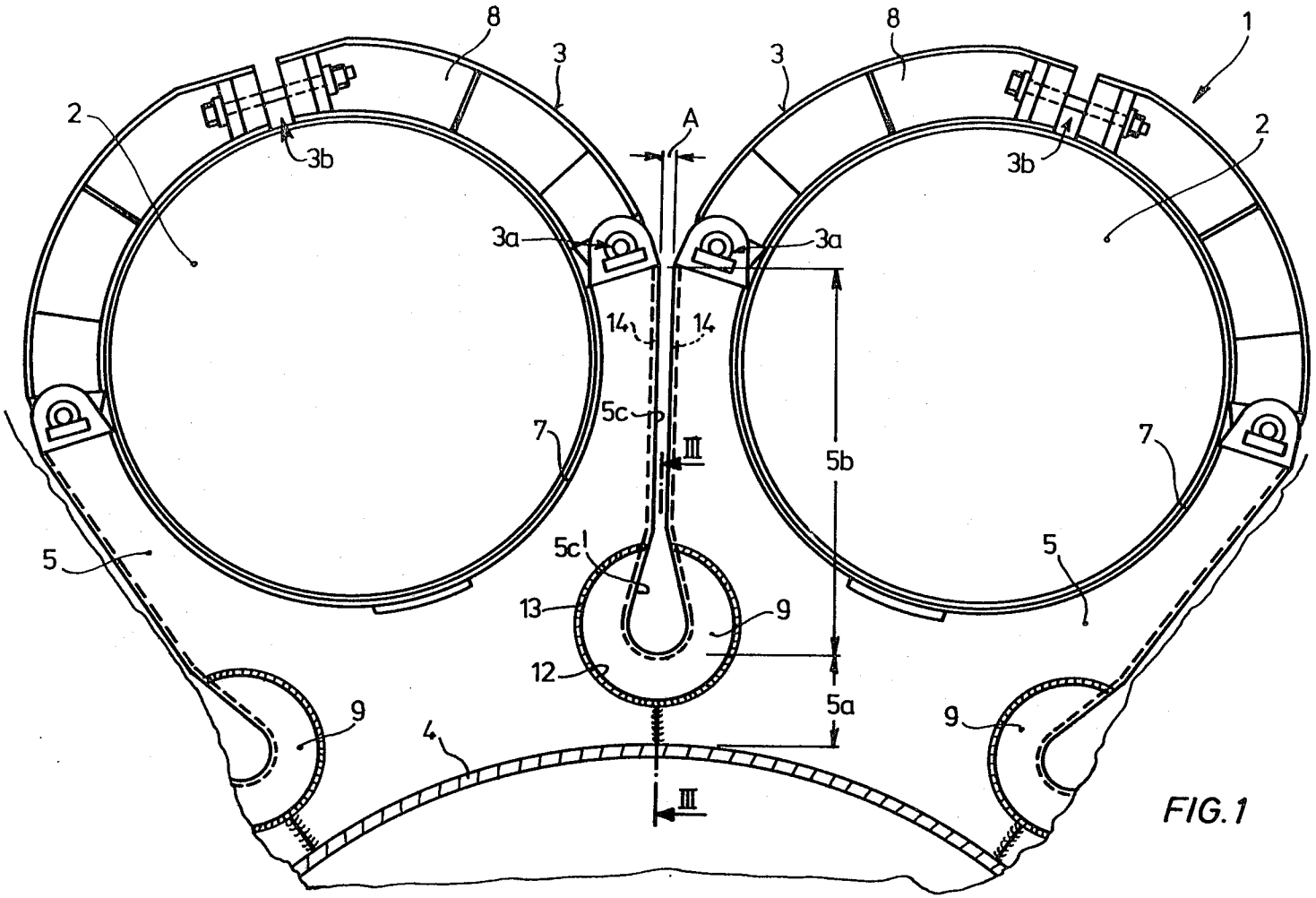
FIG. 1 is a partial cross section through the planetary cooler provided on the periphery of a revolving tubular furnace in the region of two fixed bearings.

First of all, it is pointed out that, on the whole, the drawing shows only those parts which are essential for explaining the invention, whereas other parts normally present (such as for example screw joints, tensioning elements, linings etc.) have been omitted in the interests of clarity.

The planetary cooler 1 shown in FIG. 1 comprises a suitable number of planetary cooling tubes 2 of which only two are shown in the drawing. The cooling tubes 2 are suspended around the periphery of a revolving tubular furnace by means of at least one fixed bearing and at least one floating bearing. Each fixed bearing 3 shown in FIG. 1 is connected to the mantle 4 of the revolving tubular furnace (otherwise not shown in detail) by a bearing element 5 which is essentially formed by two side plates 6 (cf. FIG. 3) and a support 7 for the associated cooling tube 2. In addition, each bearing 3 comprises a bowed bearing element 8 which is connected to the bearing element 5, the two bearing elements 5 and 8 respectively forming an inner recess in the bearing 3 for receiving the associated cooling tube 2. The two bearing elements 5, 8 are pivotally connected to one another in the usual way at the connecting points 3*a*, the bearing element 8 comprising a clamping-screw connection 3*b* for the cooling tube in its outer region.

Figure 2:
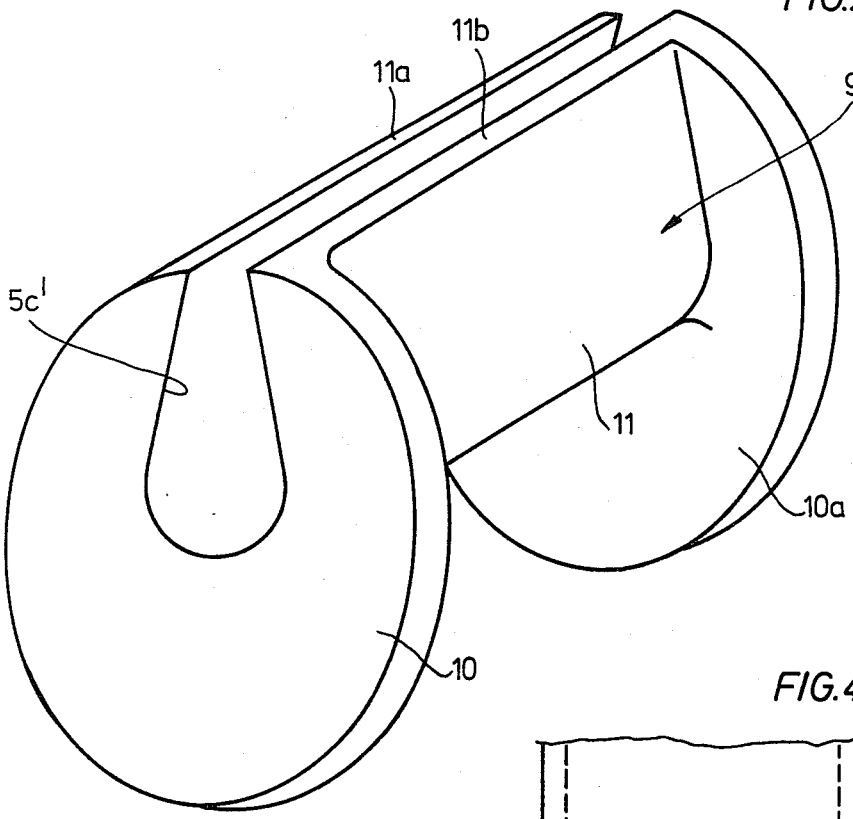
FIG. 2 is a perspective view of an insert designed to be fixed by welding in a clearance zone between adjacent bearings.

As shown in FIG. 1, bearing elements 5 adjacent one another in the peripheral direction of the furnace or rather the furnace mantle 4 are welded to one another in their inner region 5*a* adjoining the furnace mantle 4. By contrast, in their outer region 5*b* remote from the furnace mantle 4, the bearing elements 5 have a clearance A between them so that this outer region 5*b* forms a clearance pyriform or teardrop 5*c* the wider zone 5*c*′ of which extends towards the furnace mantle 4. This part 5*c*′ is formed by an insert or body 9 which, as shown by the perspective view in FIG. 2, comprises two pyriform or teardrop flanges 10, 10*a* spaced by a web 11 which connects the two flanges 10, 10*a* and which also is pyriform in cross-section, thus forming the above-mentioned zone 5*c*′. The distance between the two flanges 10, 10*a* and their thickness exactly correspond to the distance between and the respective thicknesses of the side plates 6 of the bearing element 5 (cf. also FIG. 3). The insert 9 shown in FIG. 2 may be simply and inexpensively made in the form of a casting and preferably in the form of a one-piece steel casting.

Figure 3:
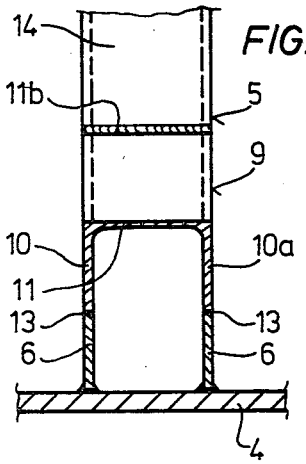
FIG. 3 is a section on the line III—III in FIG. 1 illustrating the insert formed by a casting after it has been welded in place.

As can clearly be seen from FIGS. 1 and 3, the insert 9 is fixed by welding in the adjacent regions of two adjacent bearing elements 5 in such a way that the two flanges 10, 10*a* are welded around their periphery to the side plates 6 (cut out commensurately) of the two adjacent bearing elements 5. To this end, the side plates 6 are cut out by means of a torch at the appropriate places during assembly of the planetary cooler 1, so that the associated flanges 10, 10*a* of the insert 9 fits exactly into and is welded in (cf. the weld seam 13 in FIG. 1) the resulting opening 12 of the associated side plates 6 of two bearing elements 5. It can also be seen from FIG. 3 that the outer ends of the insert 9 (outsides of the flanges 10, 10*a*) are exactly flush with the outsides of the side plates 6.

Figure 4:
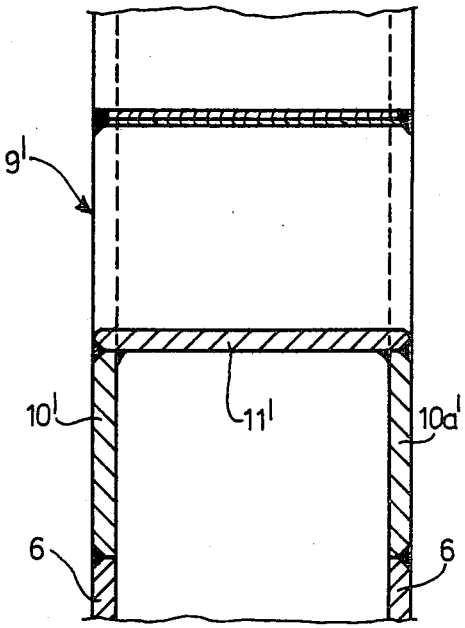
FIG. 4 is a section similar to FIG. 3, but on a larger scale, illustrating another embodiment of the insert in the form of a welded construction.

An alternative embodiment of the insert is shown in FIG. 4. In this case, the insert 9′ is formed by a welded construction in which the individually produced peripheral discs 10′, 10*a*′ are joined to one another in the manner illustrated by the pyriform web 11′, which is also individually produced, thus providing an insert 9′ of which the outer dimensions correspond exactly to those described above with reference to the insert 9 formed by a steel casting. The insert 9' is installed in the same way as the insert 9.

Both where the insert is formed by a steel casting and where it is formed by a welded construction, the flanges 10, 10*a* and 10', 10*a'* may have any suitable form. However, circular peripheral flanges are preferred because, on the one hand, they can be produced relatively easily and because, on the other hand, they provide for particularly simple formation of the corresponding openings 12 in the side plates 6.

In the case of the adjacent bearing elements 5, the front edges of the side plates 6 which face one another outside the insert 9, 9' in the clearance zone 5*c* may in general be uncovered. However, a particularly stable construction is obtained if a continuous belt, as denoted by the reference character 14 in FIG. 1, is provided between two peripherally adjacent bearing elements 5 in the clearance zone 5*c*. This continuous belt 14 connects the front edges (facing in the peripheral direction of the furnace mantle 4) of the two side plates 6 of two adjacent bearing elements 5 and, at the same time, covers these front edges (cf. FIGS. 1 and 3). In the inner part of the clearance zone 5*c*, i.e. in the region of the zone 5*c'*, the continuous belt 14 is formed by the web 11 of the insert 9 and in the radially outer part of the clearance zone 5*c*, by two sheet-metal strips of which each adjoins a free edge 11*a*, 11*b* (FIG. 2) of the insert 9, connecting and covering the front edges of the two side plates 6 facing in the peripheral direction, as shown in FIGS. 1 and 3.

The bearing elements 5 are applied to the outside of the furnace mantle 4 in the following manner:

Two adjacent bearing elements 5 are fitted together at the appropriate points of the outer periphery of the furnace mantle 4 so that their inner regions 5*a* adjoining the furnace mantle 4 support one another. In the region of the clearance zone 5*c'*, the openings 12 in the side plates 6 are cut out by means of a torch in such a way that they correspond to the size of the flanges 10, 10*a*. The openings 12 thus formed in the side plates 6 then also serve as an assembly opening, i.e. for welding the side plates 6 onto the furnace mantle 4 in the inner region of the bearing element 5 (between the two side plates 6). As a result, there is no need for a separate assembly opening to be provided in the side plates 6, in contrast to known constructions where the separate assembly opening contributes towards weakening the bearing element. After the side plates 6 have been welded onto the furnace mantle 4, the insert 9, 9' is introduced with its flanges 10, 10*a* and 10', 10*a'* fitted into and welded in (weld seam 13) the openings 12 in the side plates 6.

In the foregoing description of the embodiments illustrated in the drawing, the construction of each fixed bearing has been discussed in detail. As already mentioned in the foregoing and as is also generally known, each cooling tube is also suspended in at least one floating bearing which surrounds and retains the associated cooling tube (in contrast to the fixed bearing by which the cooling tube is held fast) in such a way that it is able to expand and contract freely which is necessary on account of the temperature fluctuations occurring. A floating bearing of this type may be constructed in largely the same way as the fixed bearing described in the foregoing. In this connection, the U-shaped bearing element may be made entirely in one piece and may merely be correspondingly screwed or otherwise connected to the associated bearing element. In other words there is no need here for a pivotal connection between the two bearing elements.

In addition, each floating bearing may also be fully integral, i.e. in one piece. In this case, the floating bearing may comprise an annular element for loosely accommodating the associated cooling tube and a furnace connecting element. This furnace connecting element may otherwise be identical in construction with the bearing element of the above-described floating bearing and the fixed bearing described with reference to the drawing, in which case the insert is also accommodated in this furnace connecting element.

At all events, the fixed and floating bearings constructed in the described manner provide not only for extremely stable and reliable welded construction for the suspension of cooling tubes of the planetary cooler, they also provide for particularly simple assembly, in addition to which it is even possible for damaged bearings of planetary cooling tubes to be subsequently modified without any difficulty.

So far as the welded construction used for the insert is concerned, it is further pointed out that, before it is used, it should preferably be heat-treated in the absence of any tension.

We claim:

1. In a planetary cooler having a plurality of cooling tubes arranged around the periphery of a revolving tube furnace having a mantle, and a radially extending, circumferentially spaced bearing support for each of said tubes, each of said bearing supports comprising a pair of axially spaced plates fixed at their radially inner ends to said mantle and to the corresponding portions of the circumferentially adjacent supports, circumferentially adjacent ones of said plates being spaced from each other radially outwardly of said portions by a clearance, and each of said plates having an opening therein at the radially inner end of said clearance, the improvement comprising an insert fixed to and extending between each circumferentially adjacent pair of said plates, each of said inserts comprising a pair of spaced flanges accommodated in the openings of axially adjacent ones of said plates and fixed to the latter, each of said flanges having a pyriform opening therein in communication with said clearance, said insert including a pyriform web joining said flanges.

2. A planetary cooler according to claim 1 wherein each of said plates of each bearing support has a radially inner, fork-shaped portion and a bowed, radially outer element releasably connected to the inner portion.

3. A planetary cooler according to claim 1 wherein the space between said flanges of said insert corresponds to the spacing between said plates and wherein the respective thicknesses of said flanges correspond to the corresponding dimensions of said plates.

4. A planetary cooler according to claim 1 wherein said insert comprises a one-piece metal casing.

5. A planetary cooler according to claim 1 wherein said insert is in the form of a welded construction.

6. A planetary cooler according to claim 1 wherein said openings and said flanges are circular.

7. A planetary cooler according to claim 1 including a belt fixed at its opposite ends to circumferentially adjacent bearing supports and having its intermediate portion extending through the clearance between such supports and fixed to said web.

8. In a planetary cooler having a plurality of cooling tubes arranged around the periphery of a revolving tube furnace having a mantle, and a radially extending, circumferentially spaced bearing support for each of said tubes, each of said bearing supports comprising a pair of axially spaced plates fixed at their radially inner ends to said mantle and to the corresponding portions of the circumferentially adjacent supports, circumferentially adjacent ones of said plates being spaced from each other radially outwardly of said portions by a clearance, and each of said plates having an opening therein at the radially inner end of said clearance, the improvement comprising an insert fixed to and extending between each circumferentially adjacent pair of said plates, each of said inserts comprising a pair of spaced flanges accommodated in the openings of axially adjacent ones of said plates and fixed to the latter, each of said flanges having an opening therein in communication with said clearance, said insert including a web joining said flanges.

* * * * *